US006002119A

United States Patent [19]

Kim

[11] Patent Number: 6,002,119

[45] Date of Patent: Dec. 14, 1999

[54] CONTROL CIRCUIT FOR MICROWAVE OVEN AND METHOD OF CONTROLLING MICROWAVE OVEN

[75] Inventor: Suk-Yong Kim, Gunpo, Rep. of Korea

[73] Assignee: Samsung Electronics Co., Ltd., Suwon, Rep. of Korea

[21] Appl. No.: 09/013,289

[22] Filed: Jan. 26, 1998

[30] Foreign Application Priority Data

Jul. 25, 1997 [KR] Rep. of Korea ..... 97-34940

[51] Int. Cl.[6] ..... H05B 6/68

[52] U.S. Cl. ..... 219/722; 219/754

[58] Field of Search ..... 219/736, 739, 219/752, 753, 754, 762, 721, 722, 723, 724

[56] References Cited

U.S. PATENT DOCUMENTS 4,629,846 12/1986 Dilyard .
4,743,727 5/1988 Joon-Yoen .
4,939,333 7/1990 Sakai et al. .
5,345,068 9/1994 Hatano et al. .

FOREIGN PATENT DOCUMENTS 3-84320 4/1991 Japan .

*Primary Examiner*—Tu Ba Hoang
*Attorney, Agent, or Firm*—Burns, Doane, Swecker & Mathis, L.L.P.

[57] ABSTRACT

A control circuit and a method of control of a microwave oven is disclosed. The control circuit having a magnetron, a door to the microwave oven's cooking chamber, a turntable installed in the cooking chamber, and a turntable motor, includes a main relay that controls the power applied to each load, including the magnetron and the turntable motor; a power relay controlling an output of the magnetron; a turntable motor relay controlling the power applied to the turntable motor; a door switch sensing the opening and closing of the door; a first switch interlocked with the door switch and controlling the power applied to the turntable motor and the magnetron as the door is opened and closed; and a turntable motor solely driver driving the turntable motor independently of the magnetron when the door is opened. The method of controlling the oven includes the steps of determining if a given period of cooking time lapses; determining if the door is opened; stopping the magnetron and the turntable motor; driving the turntable independently.

7 Claims, 7 Drawing Sheets

CONTROL CIRCUIT FOR MICROWAVE OVEN AND METHOD OF CONTROLLING MICROWAVE OVEN

This application claims priority under 35 U.S.C. §§ 119 and/or 365 to Application No. 1997-34940 filed in Korea on Jul. 25, 1997; the entire content of which is hereby incorporated by reference.

BACKGROUND OF THE INVENTION (1) Field of the Invention

The present invention relates to a control circuit for a microwave oven in general and specifically to an independently driven turntable control circuit of microwave oven and a method of controlling the microwave oven.

(2) Description of the Prior Art

A microwave oven is an electric cooking appliance which cooks food by frictional heat through high frequency energy. The water molecules contained in the food, move at high speeds, which produces heat to cook the food. An electronic shower technique using a stirrer fan and a turntable mechanism have been proposed in order to effectively apply the high frequency energy to the food being cooked.

A conventional microwave oven, employing a turntable mechanism, used because of its convenience.

FIG. 1 illustrates a circuit diagram of a microwave oven using the turntable mechanism in accordance with the conventional art. The operation of the microwave oven is now described referring to FIG. 1.

When the door of the microwave oven is closed, a door switch 14 is activated in the ON position, and a first switch 15, interlocked to the door switch 14, is also activated. If a cooking program is input to the microwave oven and the start key is pressed by the user, a control portion 30 turns on a main relay 12, thus entering the cooking operation.

As the main relay 12 is turned ON to apply power to the microwave oven, the control portion 30 controls a power relay 16 according to a cooking program set by the user, and the microwave oven performs a rapid cooking sequence. A lamp 13 is switched on to monitor the cooking state, and a fan motor 17 goes into action for cooling the magnetron 21 and ventilating the cooking chamber. A turntable is driven to apply a uniform distribution of high frequency energy to the food. The turntable motor 18 is operated to drive the turntable. The food placed in the cooking chamber is cooked by high frequencies generated from a magnetron 21 provided to the other side of a high voltage transformer of a magnetron driving portion 20.

Reference numeral 3 denotes a filter that removes a noise contained in the applied alternating current(AC) power source.

The power relay 16 is turned OFF when the programed cooking time is complete. When the door is opened, the door switch 14 is turned off and the first switch 15, connected to the door switch 14, turned off, too. Thus, when the door is opened, the power for driving the magnetron 21, the fan motor 17, and the turntable motor 18, is cut off.

In the conventional microwave oven, as the power driving the turntable motor is cut off after completion of cooking, the user rotates the container of food or the turntable manually to inspect the cooking state or takes the container out of the cooking chamber.

However, when the user tries to turn the container or the turntable manually, it is hazardous to touch the container and the turntable, as it is heated during the heating operation. By manually manipulating the contents in the cooking chamber, spills are practically inevitable. Furthermore, when cooking several items simultaneously, it is inconvenient to take anteriorly placed items out of the cooking chamber.

Based on the above and foregoing, it can be appreciated that there exists a need to obviate the above-described disadvantages of microwave ovens presently available. The present invention fulfills this need.

SUMMARY OF THE INVENTION

It is an objective of the present invention to provide a control circuit for a microwave oven which can drive a turntable motor independently when the microwave oven's magnetron and fan motor stop, thus making it easy to put food in and out of the cooking chamber when the user inspects the cooking state or cooks various food simultaneously.

In order to obtain the above-mentioned objective of the present invention, there is disclosed a control circuit for controlling a microwave oven having a magnetron for producing high frequency energy to cook a food, a door for opening and closing the cooking chamber, which prevents leaks of high frequency energy during operation, a turntable installed in the cooking chamber, on which the food is put, and a turntable motor that rotates the turntable. The control circuit includes a main relay, that controls the power applied to each load including the magnetron and the turntable motor; a power relay controlling the output of the magnetron; a turntable motor relay controlling the power applied to the turntable motor; a door switch sensing the opening and closing of the door; a first switch interlocked with the door switch and controlling the power applied to the turntable motor and the magnetron; and a turntable motor means for solely driving the turntable motor independently of the magnetron when the door is opened the power, applied to the turntable motor and the magnetron, is cut off.

The control circuit for the microwave oven further includes a second switch, interlocked with the door switch and controlling the power applied to the magnetron as the door is opened and closed.

The turntable motor solely driver includes a turntable motor driving signal input means used for inputting a turntable motor driving signal to the microwave oven; and a turntable motor solely driving relay controlled by the applied turntable motor driving signal and applying the power across the turntable motor independently of the magnetron.

The turntable motor solely driving relay has an ON-OFF contact connected between a back of the main relay's contact and the turntable motor. The turntable motor solely driving relay has an ON-OFF contact connected between a front end of the main relay's contact and the turntable motor.

According to another aspect of the present invention, a control circuit for controlling a microwave oven having a magnetron producing high frequency energy to cook food, a door to the microwave oven's cooking chamber for preventing a leak of high frequency energy during operation of the magnetron, a turntable installed in the cooking chamber, and on which the food is put, a turntable motor rotating the turntable, a main relay controlling power applied to each load including the magnetron and the turntable motor, a power relay controlling an output of the magnetron, and a turntable motor relay controlling the power applied to the turntable motor, the control circuit including a turntable motor solely driving switch driving the turntable motor independently of the magnetron in case that the magnetron and the turntable motor stop at the same time.

The control circuit also includes a door switch which is in ON/OFF state as the door is opened or closed. As the door is opened to make the door switch be in OFF state, the power relay and the turntable motor relay are turned OFF at the same time, thus stopping the operation of the magnetron and turntable motor.

The control circuit further includes a first switch which is interlocked with the door switch, and is in ON/OFF state as the door is opened or closed for preventing the magnetron from producing high frequency energy due to the erroneous operation of the power relay when the door is being opened.

According to still another aspect of the present invention, a method of controlling a microwave oven having a magnetron producing high frequency energy to heat a foodstuff, a door opening and closing the microwave oven's cooking chamber for preventing a leakage of the high frequency energy during operation of the magnetron, a turntable installed in the cooking chamber, and on which the foodstuff is put, a turntable motor rotating the turntable, and a control circuit with a turntable motor solely driver, the method including the steps of driving the magnetron and the turntable motor if a signal to start cooking is inputted to the microwave oven; determining whether or not a predetermined period of cooking time lapses according to a type of cooking preset by a user; if the predetermined period of cooking time lapses, stopping the operation of the magnetron and turntable motor; when a switch of the turntable motor solely driver is pressed after the door has been opened, driving the turntable motor independently; if the door is closed, stopping the operation of the turntable motor; if the predetermined period of time does not lapse, determining whether or not the door is opened; and when the door is opened, stopping the operation of the magnetron and turntable motor.

BRIEF DESCRIPTION OF THE ATTACHED DRAWINGS

DETAILED DESCRIPTION OF PREFERRED EMBODIMENTS

Figure 1:
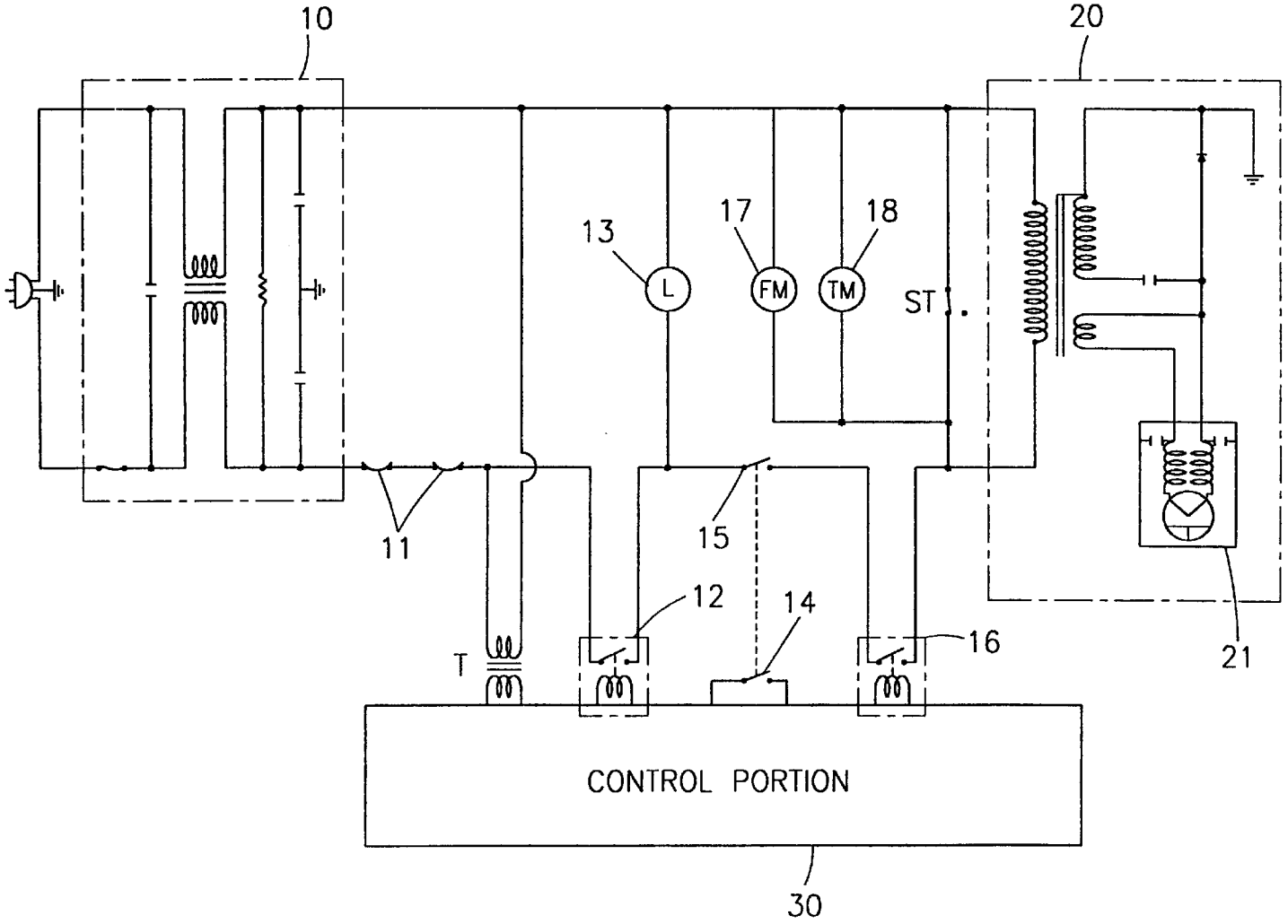
FIG. 1 illustrates a circuit diagram of a microwave oven in accordance with a conventional art.

Preferred embodiments of the present invention will be described in detail with reference to the accompanying drawings. Like reference numerals denote like reference parts throughout the specification and drawings.

First Preferred Embodiment

Figure 2:
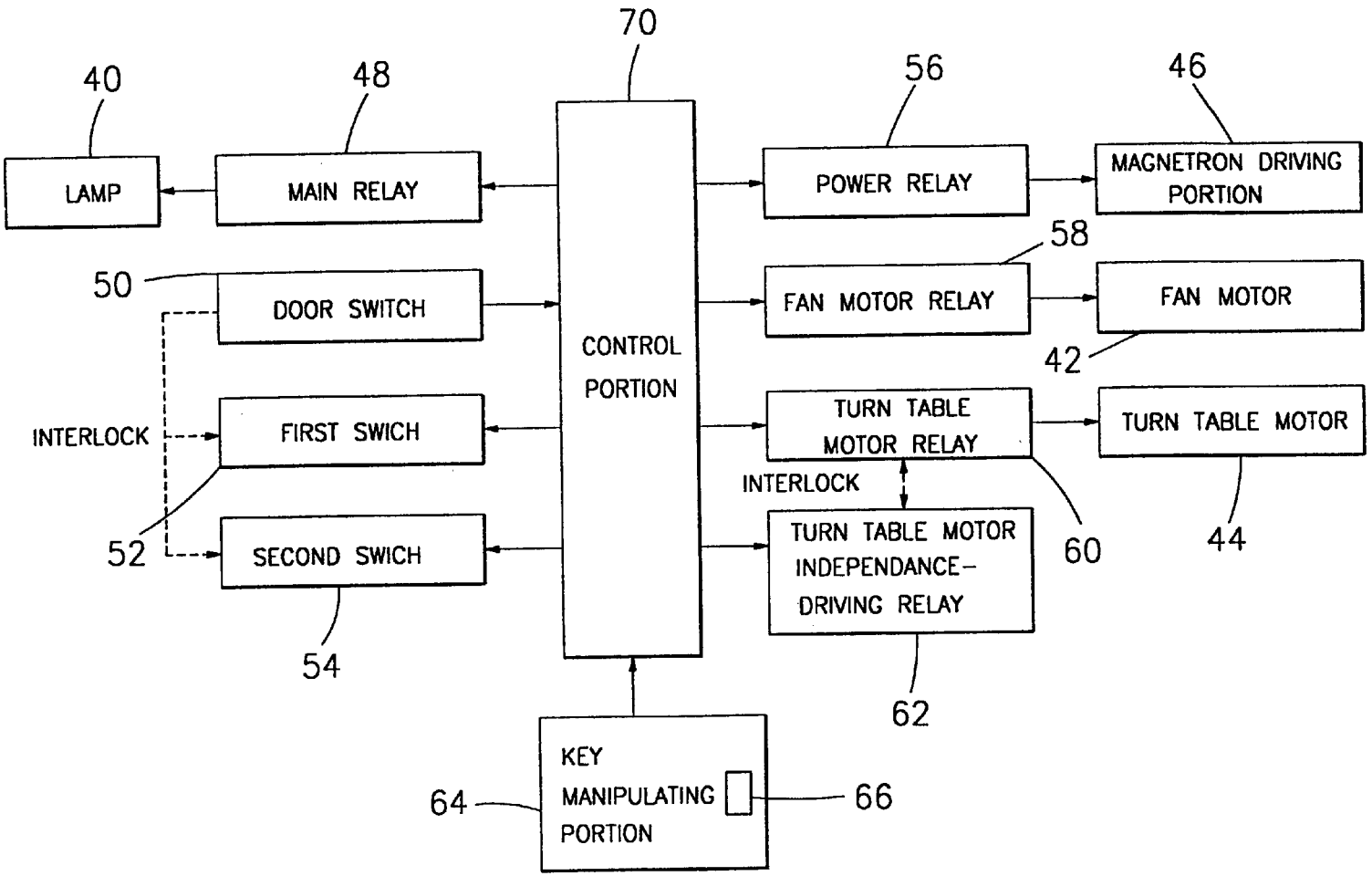
FIG. 2 is a block diagram of a microwave oven in accordance with the first and second preferred embodiments of the present invention.
Figure 3:
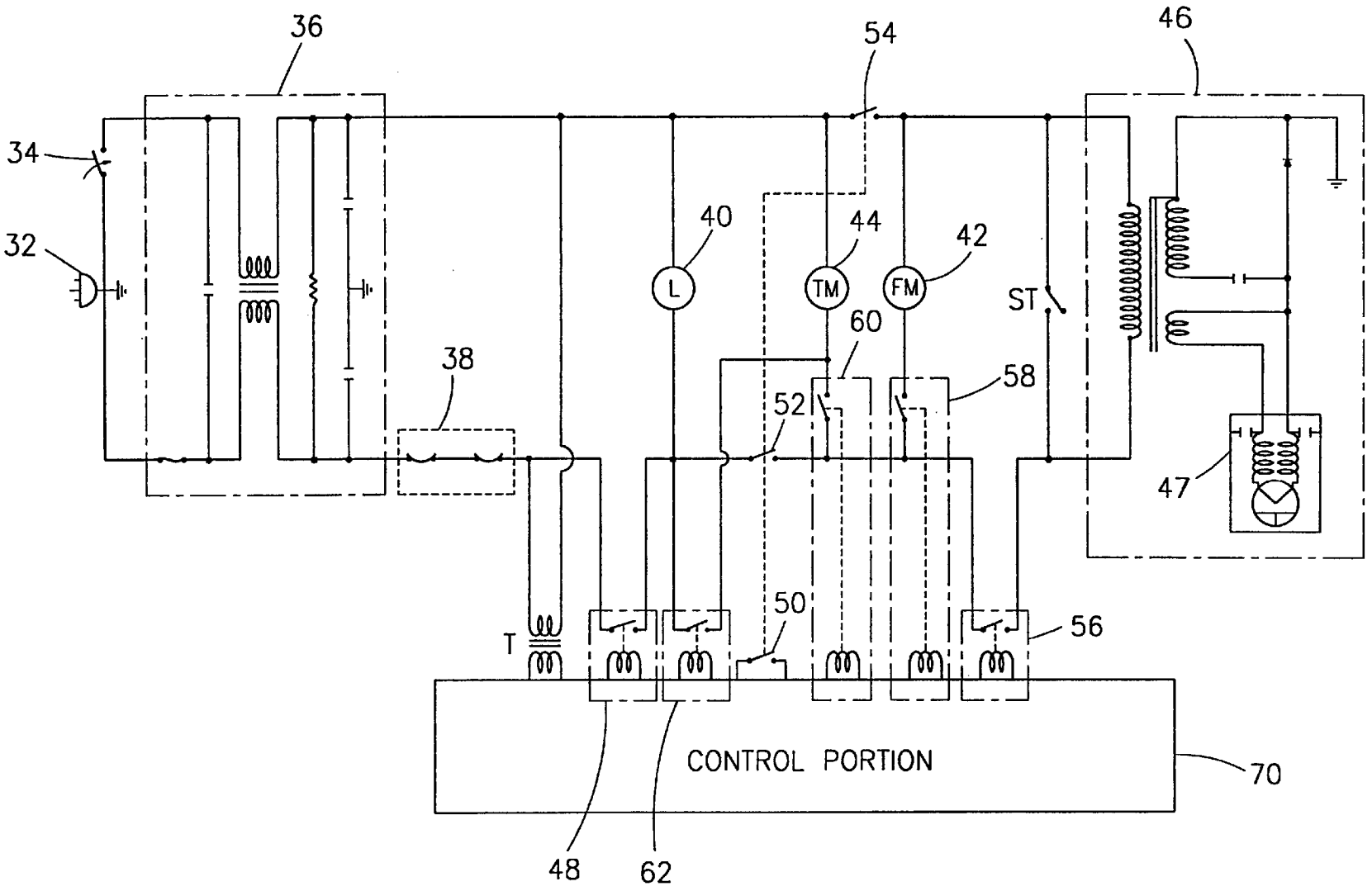
FIG. 3 depicts a control circuit for a microwave oven in accordance with the first preferred embodiment of the present invention.

FIG. 2 is a block diagram of a microwave oven in accordance with first and second preferred embodiments of the present invention, and FIG. 3 depicts a control circuit for a microwave oven in accordance with the first preferred embodiment of the present invention. The first preferred embodiment of the present invention is now described referring to FIGS. 2 and 3.

A control circuit for a microwave oven of the first preferred embodiment is divided by functions: a power supply portion, loads, and a control portion for controlling the power, applied to the loads, and the operation of each load.

The power supply portion includes a power cord 32 which is connected to the power supply; a power switch 34 serving to cut off the power applied across the microwave oven; a filter 36 for removing noise contained in the AC power applied across the control circuit; and a bimetal switch 38 serving to cut off the power if the internal temperature of the microwave oven is raised too high to prevent overheating of the microwave oven.

The loads include: a lamp 40 which illuminates the interior of the microwave oven; a fan motor 42 driving a fan for cooling the electrical component and the removal of cooking odor; a turntable motor 44 rotating a turntable on which a food to be cooked is placed so as to cook the food thoroughly; a magnetron 47 emitting high frequency energy to cook food; and a magnetron driving portion 46 actuating the magnetron 47.

The control means, controlling the power applied to the above loads and the operation of the loads, which includes a main relay 48, a door switch 50, a first switch 52, a second switch 54, a power relay 56, a fan motor relay 58, a turntable motor control relay 60, a turntable motor solely driving relay 62, a key manipulating portion 64, a turntable motor solely driving switch 66, and a control portion 70.

The main relay 48 supervises the power applied across the loads by way of the filter 36. The door switch 50 is activated as the door is opened or closed, and the first switch 52 and the second switch 54, each interlocked with the door switch 50, control the power furnished to the fan motor 42, the turntable motor 44, and the magnetron driving portion 46. The power relay 56 controls the output of the magnetron 47 according to the cooking program that the microwave oven can provide, and the fan motor relay 58 controls the power applied to the fan motor 42. The turntable motor control relay 60 controls the power applied to the turntable motor 44. A command to set the function of the microwave oven and select a type of cooking is input to the control portion 64 of the microwave oven through the key manipulating portion 64. The turntable motor solely driving switch 66 serves to turn ON the turntable motor solely driving relay 62 to apply the power to the turntable motor 48 when the power, applied to the fan motor 42, the turntable motor 44, and the magnetron driving portion 46, is cut off as the door is opened. The control portion 70 controls the relays and switches according to signals input through the key manipulating portion 64 and preset operating program.

Reference letter ST denotes a short switch used for preventing the magnetron 47 from generating high frequency energy due to the erroneous operation of the first switch 52 and/or second switch 54, and reference letter T designates a small-sized transformer used for applying the power to the control portion 70.

The following description relates to the construction and operation of the control circuit in accordance with the first preferred embodiment of the present invention.

The power cord 32 is located at the forefront of the control circuit, and a power switch 34 is connected to the power cord 32 for turning ON/OFF the power applied to the microwave oven. The filter 36 removes undesirable noise contained in the applied AC power through the power switch 34. The bimetal switch 38 is connected to the filter 36, and monitors the internal temperature of the cooking chamber (not illustrated). If the temperature is higher than a predetermined temperature, the bimetal switch 38 cuts off the power applied to the microwave oven in order to prevent overheating of the microwave oven.

At the rear end of the filter 36 and the bimetal switch 38, the small-sized transformer T is connected to the control portion 70 to apply the power to the control portion 70. If the power cord 32 is connected to the power supply and the power switch 34 is in ON state, the power is applied to the control portion 70.

At the rear end of the small-sized transformer T, the lamp 40, the turntable motor 44, the fan motor 42, and a high voltage transformer used for applying power to the magnetron driving portion 46 are connected in parallel to each other.

The main relay 48, controlled by the key manipulating portion 64, is connected between the transformer T and the loads such as the lamp 40 and the turntable motor 44, thus the power applied to the loads is controlled.

The door switch 50 is connected to the control portion 70 for monitoring the opening and closing of the door. The first switch 52, is interlocked with the door switch 50, and is connected between the main relay 48 and the rear end of the lamp 40. The second switch 54 is also interlocked with the door switch 50, and is connected between the turntable motor 44 of the first switch 52 and the fan motor 42. The first switch 52 and the second switch 54 each turn the power on and off as the door opened and closed.

The power relay 56 is connected between the fan motor 42 and the magnetron driving portion 46 for controlling the output of the magnetron 47 according to the output signal of the control portion 70. The power relay 56 controls the output of the magnetron 47 according to a selected cooking program. Controlling the output of the magnetron 47 is performed at the time the power relay 56 is turned on/off. The ON/OFF cycle is controlled by the preset program in the control portion 70 according to the type of cooking.

The turntable motor control relay 60 is interposed between the first switch 52 and the turntable motor 44, and controls the driving of the turntable motor 44 according to the output signal of the control portion 70. The turntable motor solely driving relay 62 is connected between the main relay 48 and the turntable motor 44. When the door is opened and the first switch 52 and the second switch 54 are each in OFF state, the turntable motor solely driving relay 62 is turned ON/OFF by pressing or not pressing the turntable motor solely driving switch 66, provided to the key manipulating portion 64.

The turntable motor relay 60 and the turntable motor solely driving relay 62 are interlocked with each other in the control portion 70 to prevent a short circuit, so that the two relays cannot be simultaneously turned ON.

In accordance with the first preferred embodiment of the present invention, if power, applied to the turntable motor 44, the fan motor 42, and the magnetron driving portion 46, is cut off in the control circuit, the turntable motor solely driving switch 66 is pressed to turn ON the turntable motor solely driving relay 62, allowing the turntable motor 44 to drive independently of the fan motor 42 and the magnetron 47.

The following description concerns the operation of the control circuit of the microwave oven in accordance with the first preferred embodiment of the present invention.

Once the power cord 32 is connected to the power supply and the power switch 34 is ON, AC power is applied to the control portion 70 through the small-sized transformer T for the control of power.

After that, as the user selects the type of cooking by working on the key manipulating portion 64 and presses the start key of cooking, the main relay 48 is turned ON and the lamp 40 is turned ON. The relays including the power relay 56 are turned ON according to the program preset in the control portion 70, thus performing cooking.

The cooking operation is carried out in the above process, and if the cooking time lapses, the main relay 48, the power relay 56, the fan motor relay 58, and the turntable motor control relay 60 are all simultaneously turned OFF according to an output signal of the control portion 70.

When cooking is complete and the user opens the door, the door switch 50 becomes in the OFF state, and the first switch 52 and the second switch 54, each interlocked with the door switch 50, also become in the OFF state. If the door is opened during cooking, the door switch 50 becomes in the OFF state. And the first switch 52 and the second switch 54, interlocked with the door switch 50, also become in the OFF state.

If the first switch 52 and the second switch 54 are all in the OFF state, the power applied to the fan motor 42, the turntable motor 44, and the magnetron driving portion 46, is also cut off, thus stopping the operation of each. If the door is opened, the power relay 56, the fan motor relay 58, and the turntable motor control relay 60 are turned OFF along with the main relay 48.

If the user presses the turntable motor solely driving switch 66 of the key manipulating portion 64, the main relay 48 and the turntable motor solely driving relay 62 are turned ON, thus driving the turntable motor 44.

According to the first preferred embodiment of the present invention, when a user opens the door prior to, after, or during cooking, the turntable motor 44 is independently driven by the turntable motor solely driving switch 66, which is easy for the operator to put a container of food on the turntable and to inspect the cooking state.

Second Preferred Embodiment

Figure 4:
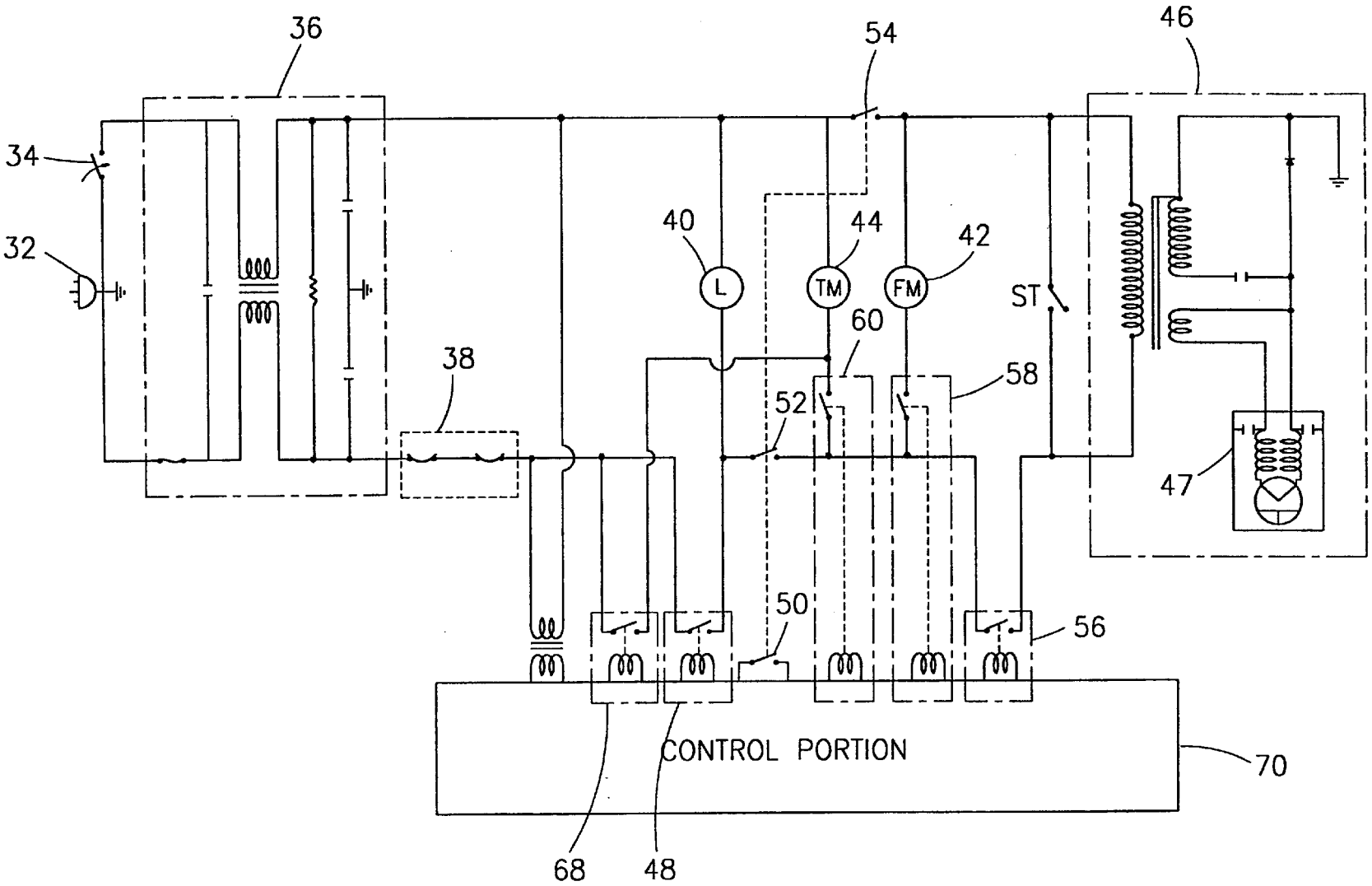
FIG. 4 depicts a control circuit for a microwave oven in accordance with the second preferred embodiment of the present invention.

FIG. 2 is a block diagram of a microwave oven in accordance with a second preferred embodiment of the present invention, and FIG. 4 depicts a control circuit for a microwave oven in accordance with the second preferred embodiment of the present invention.

The control circuit of the second preferred embodiment is the same as that of the first preferred embodiment in elements of circuit. According to the second preferred embodiment, a power input side of an ON-OFF contact of a turntable motor solely driving relay 68 is connected in front of the main relay 48. This is different from the first preferred embodiment of the present invention in which the power input side of the contact of the turntable motor solely driving relay 62 is connected to back of the main relay.

When the door is opened, the door switch 50 is in the OFF state. Even if the main relay 48 is turned OFF, the user can turn ON the turntable motor solely driving relay 68 by pressing the turntable motor solely driving switch 66 so that the turntable motor 44 is driven independently. As described above, the second preferred embodiment of the present invention is similar to the first preferred embodiment in operation and construction except for the main relay 48 and the turntable motor relay 68.

Third Preferred Embodiment

Figure 5:
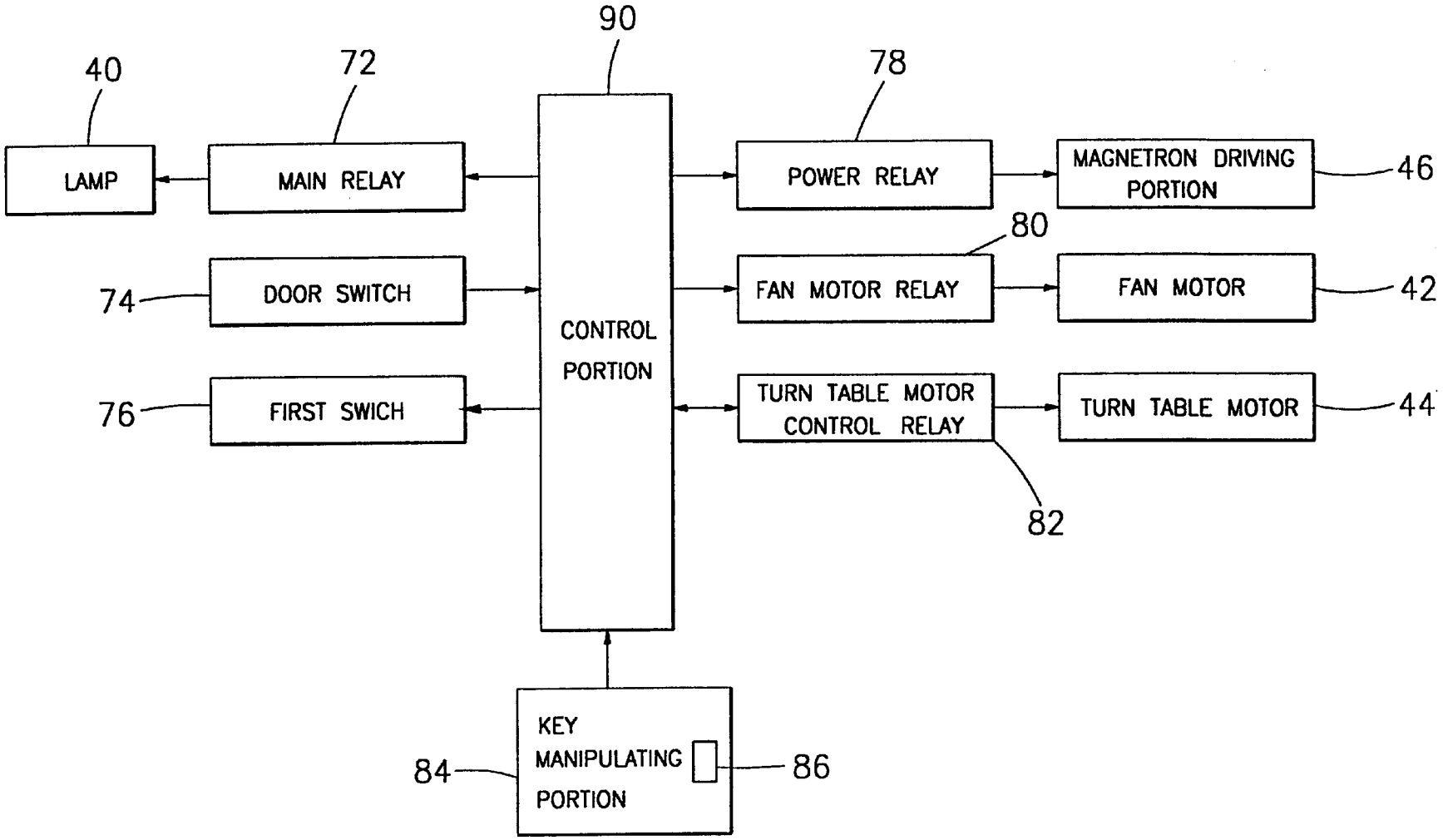
FIG. 5 is a block diagram of a microwave oven in accordance with a third preferred embodiment of the present invention.
Figure 6:
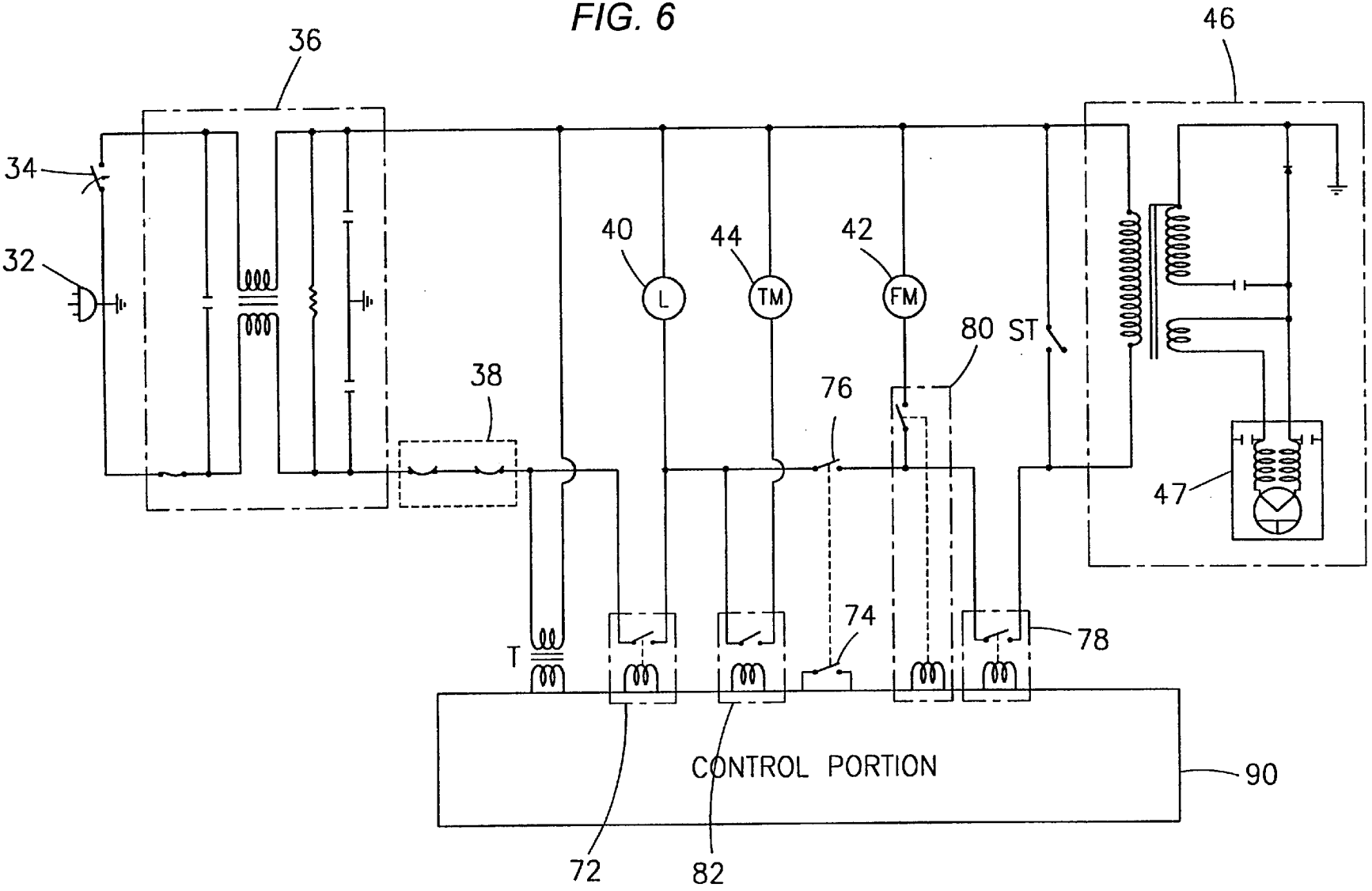
FIG. 6 is a circuit diagram of the microwave oven in accordance with the third preferred embodiment of the present invention.

FIG. 5 is a block diagram of a microwave oven in accordance with a third preferred embodiment of the present invention, and FIG. 6 is a circuit diagram of the microwave oven in accordance with the third preferred embodiment of the present invention.

Referring to FIGS. 5 and 6, the third preferred embodiment of the present invention is now described in detail.

The control circuit for the microwave oven includes a power supply portion, loads, and control means. The power supply portion and loads are the same as those of the first and second preferred embodiments.

The control means includes: a main relay 72, a door switch 74, a first switch 76, a power relay 78, a fan motor relay 80, a turntable motor control relay 82, a key manipulating portion 84, a turntable motor solely driving switch 86, and a control portion 90.

The first switch 76 is connected between the main relay 72 and the fan motor 42. The turntable motor control relay 82 is connected between the main relay 72 and the turntable motor 44 for controlling the operation of the turntable motor 44.

In the control circuit of the third preferred embodiment of the present invention, as the door is opened, the door switch 74 is in the OFF state, and the first switch 76 that is interlocked with the door switch 74 becomes in the OFF state, thus cutting off the power applied to the fan motor 42 and the magnetron driving means 46. According to the feature of the third preferred embodiment of the present invention, the control portion 90 of the control circuit has a program that the power relay 78, the fan motor relay 80, and the turntable motor control relay 82 are all turned OFF while the door switch 74 is OFF.

If the main relay 72, the first switch 76, the power relay 78, the fan motor relay 80, and the turntable motor control relay 82 are turned OFF as the door is opened, the main relay 72 and the turntable motor control relay 82 are turned ON by pressing the turntable motor solely driving switch 86, thereby driving the turntable motor 44. Accordingly, since the turntable motor 44 is driven in this way, it is easy for the user to either see the cooking state or bring a food container out of the cooking chamber.

Fourth Preferred Embodiment

The fourth preferred embodiment of the present invention is now described in detail referring to FIGS. 2 to 7.

Figure 7:
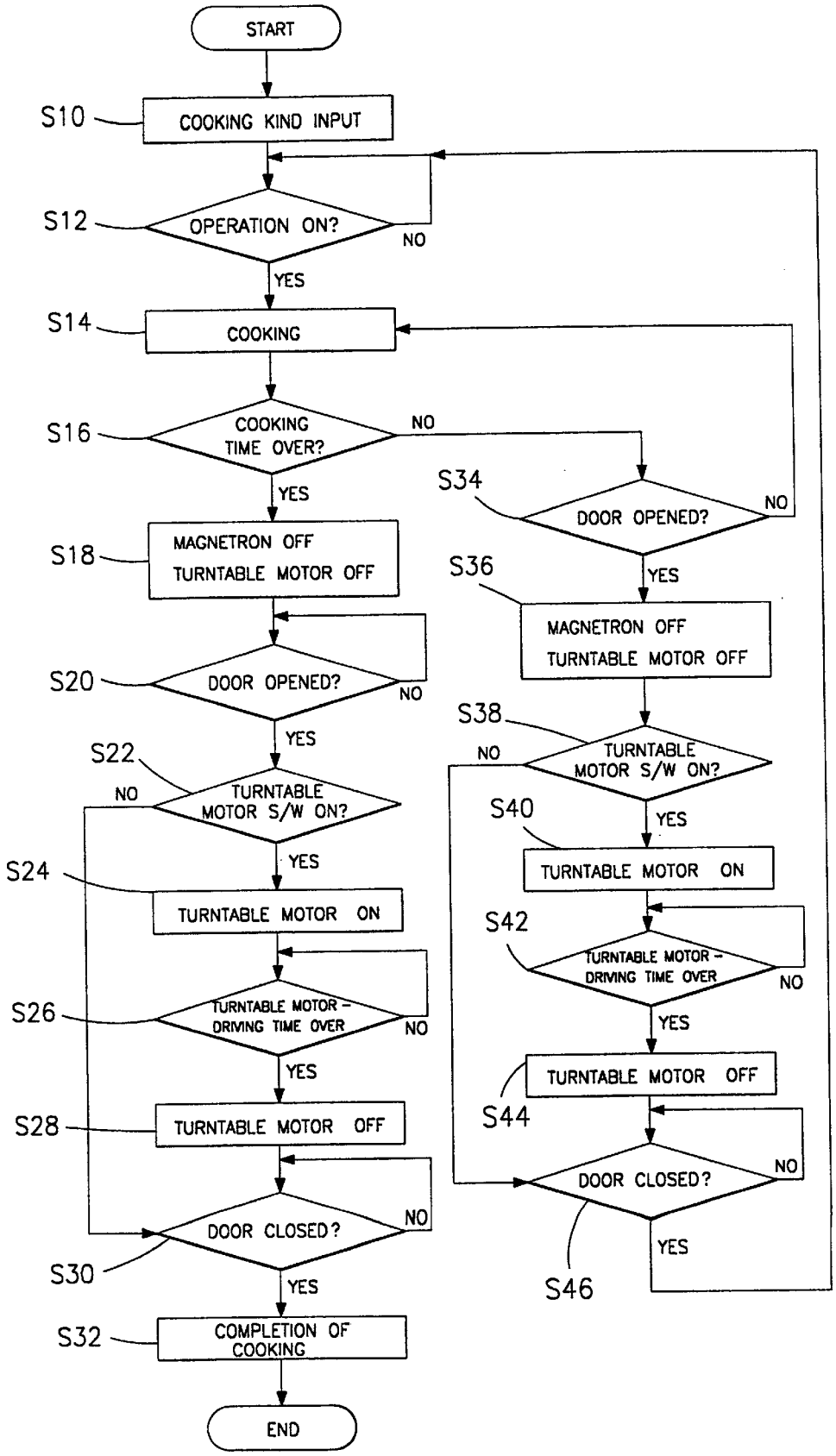
FIG. 7 depicts the control sequence of a microwave oven in accordance with a fourth preferred embodiment of the present invention.

FIG. 7 depicts the control sequence of a microwave oven in accordance with the fourth preferred embodiment of the present invention.

After food has been put in the cooking chamber and the microwave oven's door is closed, power is applied to the microwave oven. The cooking program is inputted (S10) to the microwave oven by the user via the key manipulating portion 64 or 84. When the cooking start key of the key manipulating portion 64 or 84 is pressed, after the cooking program has been inputted, the control portion 70 or 90 determines whether or not a signal to start cooking is inputted thereto. Once the signal to start cooking is inputted to the control portion 70 or 90, the control portion 70 or 90 turns on the main relay 48 or 72, thus switching on the lamp 40 (S12).

The power relay 56 or 78, the fan motor relay 58 or 80, and turntable motor control relay 60 or 82 are all turned on according to the program stored in the control portion 70 or 90 to drive the magnetron 47, the fan motor 42 and the turntable motor 44, thus performing the cooking operation (S14).

When the cooking is being carried out, the control portion 70 or 90 determines (S16) whether or not the cooking time, set by the user, lapses.

If the cooking time lapses, the control portion 70 or 90 turns off the main relay 48 or 72, the power relay 58 or 80, the turntable motor relay 60 or 82, thus stopping the magnetron 47, the fan motor 42 and the turntable motor 44 (S18).

If the user opens the door in order to bring food out of the cooking chamber, the control portion 70 or 90 determines via the door switch 50 or 74 if the door is opened (S20).

If the turntable motor solely driving switch 66 or 86 is pressed after the door has been opened, the control portion 70 or 90 determines if the turntable motor driving signal is inputted thereto (S22). The control portion 70 or 90 turns on the main relay 48 or 72, the turntable motor solely driving relay 62 or 68, or the turntable motor control relay 82 according to the turntable motor driving signal.

If the user does not press the turntable motor solely driving switch 66 or 86 at S22, the control portion 70 or 90 goes to S30.

If the main relay 48 or 72, the turntable motor solely driving relay 62 or 68, or the turntable motor control relay 82 is turned on, the turntable motor 44 is driven independently for a predetermined period of time, thus rotating the turntable (S24).

The control portion 70 or 90 determines whether or not the preset time for driving the turntable motor 44 elapses while the turntable motor 44 is being driven independently. When the control portion 70 or 90 determines that the preset time for driving the turntable motor 44 does not elapse, it allows the turntable motor 44 to be driven continuously (S26). When the preset time for driving the turntable motor 44 elapses, the control portion 70 or 90 stops the operation of the turntable motor 44 (S28). As the door is closed after stopping the turntable motor 44, the control portion 70 or 90 determines that the door is closed (S30).

Once the door is closed at S30, the control portion 70 or 90 completes the cooking (S32).

If the control portion 70 or 90 determines that the cooking time does not lapse at S16, it checks if the door is opened by the user. When the control portion 70 or 90 determines that the door has not been opened by the user, it allows the microwave oven to go on cooking. On the contrary, if it determines that the door has been opened, it goes to the next step (S34).

When the door is opened, the control portion 70 or 90 confirms the opening of the door via the door switch 50 or 74, and turns off the main relay 48 or 72, the power relay 56 or 78, the fan motor relay 58 or 80, and the turntable motor control relay 60 or 82; thus stopping the magnetron 47, the fan motor 42 and the turntable motor 44. As the door is opened, the first switch 52 or 76 and the first switch 54, each interlocked with the door switch 50 or 74, are in OFF state to prevent the magnetron 47 from generating high frequency energy due to the erroneous operation of the relays. The control portion 70 or 90 computes the remaining cooking time and stores it (S36) when the magnetron 47 stops, thus suspending cooking.

Once the turntable motor solely driving switch 66 or 86 is pressed after the door has been opened, the control portion 70 or 90 determines if a turntable motor driving signal is input thereto (S38). The control portion 70 or 90 turns on the main relay 48 or 72, the turntable motor solely driving relay 62 or 68, or the turntable motor control relay 82 according to the turntable motor driving signal, thus driving the turntable motor 44 independently (S40).

If the turntable motor solely driving switch 66 or 86 is not pressed at S38, the control portion 70 or 90 goes to S42.

While the turntable motor 44 is being driven independently, the control portion 70 or 90 checks whether or not the preset time for driving the turntable motor 44. If the control portion 70 or 90 determines that the preset time for driving the turntable motor 44 does not lapse, it allows the turntable motor 44 to keep operating. On the contrary, when the control portion 70 or 90 determines that the preset time for driving the turntable motor 44 does elapse, it stops the turntable motor 44 (S40).

If the user closes the door after the turntable motor 44 has stopped at S40, the control portion 70 or 90 confirms that the door is closed. As the door is closed, the control portion 70 or 90 goes to S12, and in case that the door is not closed, it repeats this step (S42).

After cooking stops as the door is opened S34, once the door is closed (S42) and the key to start cooking is pressed, the cooking is performed again for the remaining cooking time stored in the control portion 70 or 90 at S32.

Various modifications may be made without shaping from the spirit or scope of the general inventive concept as defined by the appended claims and their equivalents. For example, in the present invention, the turntable of the microwave oven may be independently rotated, elevated, or taken out of the cooking chamber. Further, the present invention may be applied to another electric appliances.

As described above, the step of rotating the turntable independently by pressing the turntable solely driving switch or turntable motor solely driving switch is also programmed in the control circuit for the microwave oven and its control method in accordance with the present invention. This makes it easy to either see the cooking state during cooking or bring a food container out of the cooking chamber of the microwave oven after cooking.

What is claimed is:

1. In a microwave oven with a magnetron producing high frequency energy to cook food, a door for opening and closing the cooking chamber of the microwave for preventing a leakage of the high frequency energy during operation of the magnetron, a turntable installed in the cooking chamber, and on which the foodstuff is put, and a turntable motor rotating the turntable, a control circuit for controlling the operation of the microwave oven comprising:

a main relay for controlling the power applied to at least the magnetron and the turntable motor;

a power relay for controlling the output of the magnetron;

a turntable motor relay for controlling the power applied to the turntable motor;

a door switch sensing the opening and closing of the door;

a first switch interlocked with the door switch and controlling the power applied to the turntable motor and the magnetron as the door is opened and closed;

turntable motor solely driving means for driving the turntable motor independently of the magnetron when the door is opened; and a control portion interconnecting said main relay, said power relay, said turntable motor relay, said door switch, said first switch and said turntable motor solely driving means.

2. A control circuit for a microwave oven as set forth in claim 1, further comprising a second switch, interlocked with the door switch and controlling the power applied to the magnetron as the door is opened and closed.

3. A control circuit for a microwave oven as set forth in claim 1, wherein the turntable motor solely driving means includes:

a turntable motor driving signal input means used for inputting a turntable motor driving signal to the microwave oven; and a turntable motor solely driving relay controlled by the applied turntable motor driving signal and applying the power across the turntable motor independently of the magnetron.

4. A control circuit for a microwave oven as set forth in claim 3, wherein the turntable motor solely driving means has an ON-OFF contact connected between said main relay and said turntable motor.

5. A control circuit for a microwave oven as set forth in claim 3, wherein the turntable motor solely driving means has an ON-OFF contact connected between said main relay and said turntable motor.

6. In a microwave oven having a magnetron producing high frequency energy to heat a foodstuff, a door opening and closing a cooking chamber of the microwave oven for preventing a leakage of the high frequency energy during operation of the magnetron a turntable installed in the cooking chamber, and on which the foodstuff is put, a turntable motor rotating the turntable, a main relay controlling power applied to at least the magnetron and the turntable motor, a power relay controlling an output of the magnetron, and a turntable motor relay controlling the power applied to the turntable motor, a control circuit for controlling the operation of the microwave oven comprising:

a turntable motor solely driving switch for selectively driving the turntable motor independently of the magnetron;

a door switch which is in the ON/OFF state as the door is opened or closed; and a first switch which is interlocked with the door switch, and is in the ON/OFF state as the door is opened or closed to prevent the magnetron from producing high frequency energy due to operation of the power relay when the door is being opened.

7. A method of controlling a microwave oven having a magnetron producing high frequency energy to cook a food, a door to the microwave oven's cooking chamber for preventing a leak of high frequency energy during the operation of the magnetron, a turntable installed in the cooking chamber, on which the food is placed, a turntable motor rotating the turntable, and a control circuit with a turntable motor solely driving means, said method comprising the steps of:

driving the magnetron and the turntable motor if a signal for start cooking is input to the microwave oven;

determining whether or not a predetermined period of cooking time elapses according to a type of cooking preset by a user;

if the predetermined period of cooking time has elapsed, stopping the operation of the magnetron and turntable motor;

when a switch of the turntable motor solely driving means is pressed after the door has been opened, driving the turntable motor independently;

if the predetermined period of time has not elapsed, determining whether or not the door is opened; and when the door is opened, stopping the operation of the magnetron and turntable motor.

* * * * *